US006206562B1

(12) United States Patent
Eyraud et al.

(10) Patent No.: US 6,206,562 B1
(45) Date of Patent: Mar. 27, 2001

(54) AGITATOR WITH ADJUSTABLE MAGNETIC DRIVE COUPLING

(75) Inventors: Philippe Eyraud, Dardilly; Guy Flavien, Collonges au Mont d'Or, both of (FR)

(73) Assignee: Mixel, Dardilly (FR)

( * ) Notice: Subject to any disclaimer, the term of this patent is extended or adjusted under 35 U.S.C. 154(b) by 0 days.

(21) Appl. No.: 09/459,103

(22) Filed: Dec. 13, 1999

(30) Foreign Application Priority Data

Jan. 28, 1998 (FR) ..... 99 01130

(51) Int. Cl.[7] ..... B01F 13/08
(52) U.S. Cl. ..... 366/273
(58) Field of Search ..... 366/331, 273, 366/274, 285, 286; 464/29; 417/420; 416/3

(56) References Cited

U.S. PATENT DOCUMENTS

| | | | | |
|---|---|---|---|---|
| 3,306,076 | * | 2/1967 | Cashman et al. | 464/29 |
| 3,694,341 | * | 9/1972 | Luck, Jr. | 366/273 |
| 4,209,259 | * | 6/1980 | Rains et al. | 366/273 |
| 4,993,841 | * | 2/1991 | Lofgren et al. | 366/274 |
| 5,358,332 | * | 10/1994 | Derksen et al. | 366/286 |
| 5,364,184 | * | 11/1994 | Rains | 366/274 |
| 5,378,062 | * | 1/1995 | Rains | 366/273 |
| 5,393,142 | * | 2/1995 | Meier | 366/274 |
| 5,407,272 | * | 4/1995 | Meier | 366/274 |
| 5,470,152 | * | 11/1995 | Rains | 366/273 |
| 5,478,149 | * | 12/1995 | Quigg | 366/273 |
| 5,533,803 | * | 7/1996 | Meier | 366/273 |
| 5,700,086 | * | 12/1997 | Forslund | 366/286 |
| 5,708,313 | * | 1/1998 | Bowes et al. | 417/420 |
| 5,758,965 | * | 6/1998 | Gambrill et al. | 366/273 |
| 5,779,359 | * | 7/1998 | Gambrill et al. | 366/273 |

FOREIGN PATENT DOCUMENTS

| | | | | |
|---|---|---|---|---|
| 3039810 | | 5/1982 | (DE) . | |
| 360767 | * | 3/1990 | (EP) | 366/273 |
| 399971 | * | 9/1990 | (EP) | 366/273 |
| 399972 | * | 11/1990 | (EP) | 366/273 |
| 408093 | | 1/1991 | (EP) . | |
| 437394 | | 7/1991 | (EP) . | |
| 617999 | | 5/1994 | (EP) . | |
| 60-125240 | * | 7/1985 | (JP) | 366/273 |
| 63-31528 | * | 2/1988 | (JP) | 366/273 |
| 64-56127 | * | 3/1989 | (JP) | 366/273 |
| 1-130722 | * | 5/1989 | (JP) | 366/273 |
| 6-190258 | * | 7/1994 | (JP) | 366/273 |

* cited by examiner

*Primary Examiner*—Charles E. Cooley
(74) *Attorney, Agent, or Firm*—Dowell & Dowell, P.C.

(57) ABSTRACT

A magnetically driven agitator which includes a member adapted to be mounted through a wall of a receptacle and which has a sleeve in which is housed a rotor which supports a first magnetic coupling structure. A propelling screw is disposed around the sleeve and supports a second magnetic coupling structure which cooperates with the first magnetic coupling structure in order to rotate the screw about an axis of rotation. The rotor is moveable parallel to the axis of rotation inside the sleeve between a first position where the first and second coupling structures are generally opposite to provide a maximum magnetic force therebetween to selected second positions where the magnetic force between the first and second coupling structures is varied such that the magnetic force may be reduced or substantially eliminated.

14 Claims, 4 Drawing Sheets

AGITATOR WITH ADJUSTABLE MAGNETIC DRIVE COUPLING

BACKGROUND OF THE INVENTION

1. Field of the Invention

The present invention relates to a magnetically driven agitator and to a process for adjusting the couple limiting transmission of effort of such an agitator.

2. Brief Description of the Related Art

Agitators are conventionally used for stirring a mixture contained inside a recipient in order to avoid decantation or any other alteration of the mixture in the course of time. A magnetically driven agitator has the advantage that the propelling screw which it comprises is set in motion by a magnetic coupling which occurs without physical contact between two rotating parts of which one is driven by the driven shaft of an electric motor while the other is constituted by a propelling screw. This makes it possible to arrange the part associated with the shaft of the electric motor outside the recipient while the propelling screw is installed inside the recipient. Any danger of leakage at the level of the agitator may thus be set aside. This is particularly useful when the mixture is toxic or when pollution thereof by outside agents is to be avoided, such as for example in the case of a medicinal composition.

The magnetic coupling used for an industrial agitator must be intense in order to drive the propelling screw of the agitator with a sufficient force. Now, it is sometimes necessary to proceed with dismantling of the propelling screw, in particular for reasons of maintenance or inspection of the recipient in which the mixture is formed. It is thus standard to provide cleaning the propelling screw of an agitator and/or sterilizing it outside the recipient at the end of each production batch. It is sometimes necessary to dismantle the propelling screw in order to proceed with the standard exchange of wear pieces such as bearings. When a propelling screw has been dismantled, it must be returned into position on its support with the greatest precautions, avoiding as much as possible knocks that might damage the blades, the bearings and/or the surface of the recipient.

The magnetic forces necessary for driving the propelling screw of an industrial agitator are such that the effort that an operator must exert to remove the propelling screw is considerable, as this effort must overcome both the weight of the propelling screw and the force of magnetic coupling necessary for the drive. This is even more critical when the propelling screw is replaced in position, insofar as, when it is being installed offered, it may happen that the magnetic effort is so intense that the propelling screw escapes the operator's grip and is violently applied against its support, consequently damaging the bearings and even injuring the operator.

In addition, it is particularly delicate for an operator to place the propelling screw in perfect alignment with the axis of rotation of its rotor, with the result that, if the propelling screw escapes the operator's grip due to the magnetic force that it undergoes, it tends to be applied aslant on its support, which may lead to the destruction of one of its blades, to the marking of the inner surface of the tank and/or to one of the bearings being damaged. In order to overcome this drawback, it may be envisaged systematically to dismantle the drive assembly of the propelling screw located outside the recipient, i.e. it drive motor and possibly the reduction gear which is associated therewith, in order to eliminate the magnetic forces exerted on the propelling screw in the course of assembly or dismantling. Such an approach requires that an operator manipulate heavy and cumbersome parts, these parts generally being located under the manufacturing tanks or recipients and being difficult to access. In addition, such a dismantling of these drive systems must be followed by re-assembly during which the axes of the rotating parts must be very precisely aligned, which is not always possible taking into account the difficult access to the zones of re-assembly of the motor and its possible reduction gear. Moreover, dismantling of the outer part of the agitator involves exposing the magnetic drive rotor to the open air, this rotor being provided with permanent magnets of which the outer surfaces may be covered with magnetic impurities. Taking into account the small clearance present around the rotor, these impurities may lead to a machining of the magnets and to a blockage of the agitator.

It is a particular object of the present invention to overcome these drawbacks by proposing a magnetically driven agitator of which the propelling screw may be easily dismantled and returned into place, without the risk of the magnetic forces disturbing these operations and without requiring the complete dismantling of the part of the agitator outside the recipient on which it is mounted.

SUMMARY OF THE INVENTION

To that end, the invention relates to a magnetically driven agitator which comprises a flange adapted to be tightly mounted in a wall of a recipient and provided with a blind sleeve inside which is housed a rotor supporting a first magnetic coupling means, while a propelling screw disposed around this sleeve is equipped with a second magnetic coupling means for driving this propelling screw about an axis of rotation. This agitator is characterized in that the rotor is movable in translation, parallel to this axis inside the sleeve, between a first position where the first and second coupling means are opposite, so that they cooperate for driving the propelling screw in rotation, and a second position where they do not interact, or only little, so that this propelling screw may be displaced with respect to the sleeve without noteworthy interaction of the first and second coupling means.

Thanks to the fact that the rotor is movable in translation, it may be retracted during the operations of assembly and dismantling of the propelling screw, so that the magnetic coupling means that it supports, such as permanent magnets, is spaced apart from the coupling means which equip the propelling screw by a distance sufficient to avoid the magnetic force between these coupling means disturbing the assembly or dismantling of the propelling screw. Displacement of the rotor inside the sleeve occurs in a direction corresponding to the shear of the air gap between the magnetic coupling means, i.e in practice between the permanent magnets respectively associated with the rotor and the propelling screw. Such shear perpendicular to the magnetic force created between these magnets does not require exerting a considerable effort insofar as this magnetic force does not oppose this shear. In other words, the magnetic coupling between the magnets of the rotor and of the propelling screw is nullified without this magnetic coupling greatly opposing the translation of the rotor. During assembly or re-assembly of the propelling screw, it suffices to place the latter on the sleeve, then to move the rotor in translation inside the sleeve until the magnets that it carries are opposite the magnets carries by the propelling screw. The invention therefore allows the propelling screw to be placed in position without interference with the magnets of the rotor, then to displace the rotor until it can drive the propelling screw, such displacement being effected in a direction such that it is unnecessary to overcome an intense magnetic force.

According to a first advantageous aspect of the invention, the rotor is displaced in rotation about its axis and in translation parallel to this axis by a drive shaft itself movable in rotation about this axis and in translation parallel to this axis, between two positions corresponding to the first and second positions of the rotor. The rotor can be provided to present a central recess for receiving a screw for mounting the rotor on the shaft, this screw being disposed substantially along the axis.

According to another advantageous aspect of the invention, the rotor and/or the drive shaft are adapted to be immobilized, in their movement of translation parallel to the axis, in an intermediate position between the first and second positions. This aspect of the invention makes it possible to use the agitator while the magnetic coupling effort between the rotor and the propelling screw is reduced with respect to the position where the respective coupling means are opposite, with the result that the drive couple of the propelling screw is limited. This is advantageous when it is desired to use the agitator with a mixture whose viscosity is variable, for example due to a chemical reaction. In that case, the agitator is blocked when the viscosity of the mixture is such that the couple which can be transmitted to the propelling screw is less than that which would be necessary to set it in motion in the mixture.

According to another advantageous aspect of the invention, the drive shaft is mounted to slide inside a hollow driven shaft of a reduction gear, these drive shaft and hollow shaft being corrected in rotation. Reduction gear is understood to mean any device for transmitting a movement of rotation, whatever its reduction ratio. In particular, it may be a bevel gear of ratio 1/1. The hollow shaft may be provided to bear a nut whose inner thread is adapted to cooperate with an outer thread of a threaded rod secured to the drive shaft. This makes it possible to create a nut and endless screw system for adjusting the position of the drive shaft and of the rotor in translation. The threaded rod is advantageously provided, at one of its ends projecting outside the hollow shaft, with means for controlling its rotation about its axis. In that case, a cap for protecting this end of the threaded rod and these control means may be provided, such cap being removably mounted on the reduction gear.

According to a variant embodiment of the invention, the rotor may be controlled in translation along the axis by a pneumatic or hydraulic jack.

The invention also relates to a process for adjusting the couple limiting transmission of force of an agitator as described hereinbefore, which consists in adjusting the position of the rotor along an axis, so that the first and second magnetic coupling means are more or less opposite. Thanks to the process of the invention, the couple transmissible between the rotor and the propelling screw is more or less great, as indicated hereinabove.

BRIEF DESCRIPTION OF THE DRAWINGS

The invention will be more readily understood on reading the following description of two embodiments of a magnetically driven agitator in accordance with its principle and of their process of adjustment, given solely by way of example and made with reference to the accompanying drawings, in which.

DESCRIPTION OF PREFERRED EMBODIMENTS

Figure 1:
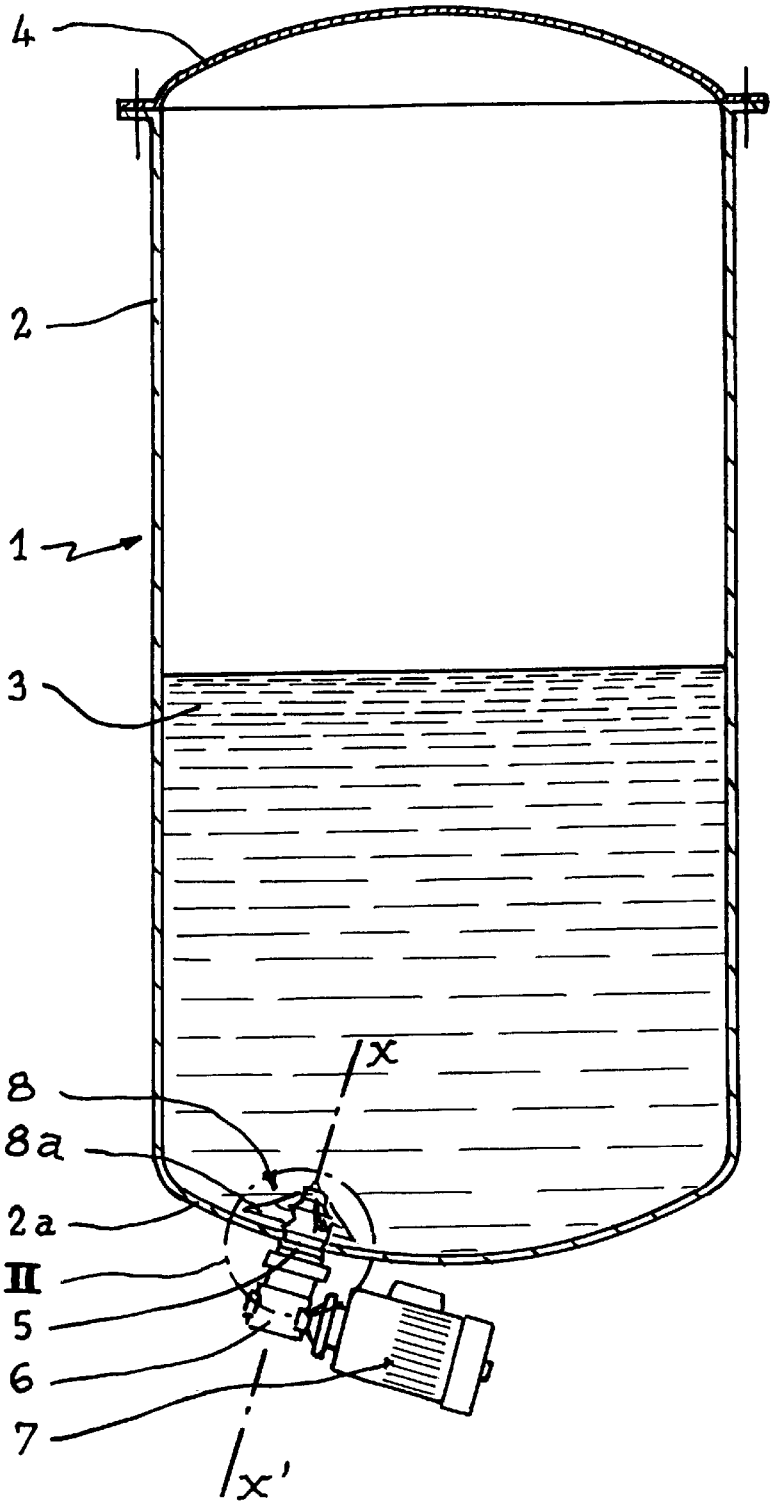
FIG. 1 schematically shows a recipient for a mixture equipped with an agitator according to the invention.

Referring now to the drawings, FIG. 1 shows a recipient 1 formed by a tank 2 and containing a mixture 3, while a lid 4 is provided to obturate an upper opening of the tank.

In the bottom wall 2*a* of the tank 2 is disposed a flange 5 made of a magnetic material supporting a reduction gear 6 and an electric motor 7, located outside the tank 2. A propelling screw 8 is arranged inside the tank 2, in the mixture 3. The rotation of the propelling screw 8 by the motor 7 results in a displacement of its blades 8*a*, of which two are visible in the Figures, around an axis of rotation X–X', which has the effect of stirring the mixture 3.

The flange 5 forms a blind or hollow sleeve 10 which extends inside the tank 2. A bearing 11 is mounted on the end 10*a* of the sleeve 10 thanks to a pin 12 whose threaded end 12*a* is received in a tapping 10*b* of the end 10*a* of the sleeve 10. The bearing 11 supports a bush 13 of which the outer surface 13*a* constitutes a bearing surface. The propelling screw 8 comprises a head 14 formed by a ring 15 whose inner circular surface 15*a* is intended to fit around the surface 13*a* of the bush 13. A smooth bearing is thus produced by contact, for example metal metal, between surfaces 13*a* and 15*a*.

Three branches, of which two, referenced 15*b*, are visible in the Figures, and which are regularly distributed on the periphery of the ring 15, extend outwardly therefrom and support a sheath 16 disposed around the blind sleeve 10. The blades 8*a* of the propelling screw 8 are welded on the outside of the sheath 16. This sheath 16 bears, on its inner surface 16*a* directed toward the sleeve 10, two rows of permanent magnets 17 whose north-south polarity is directed in directions A–A' and B–B' substantially perpendicular to axis X–X'.

Figure 2:
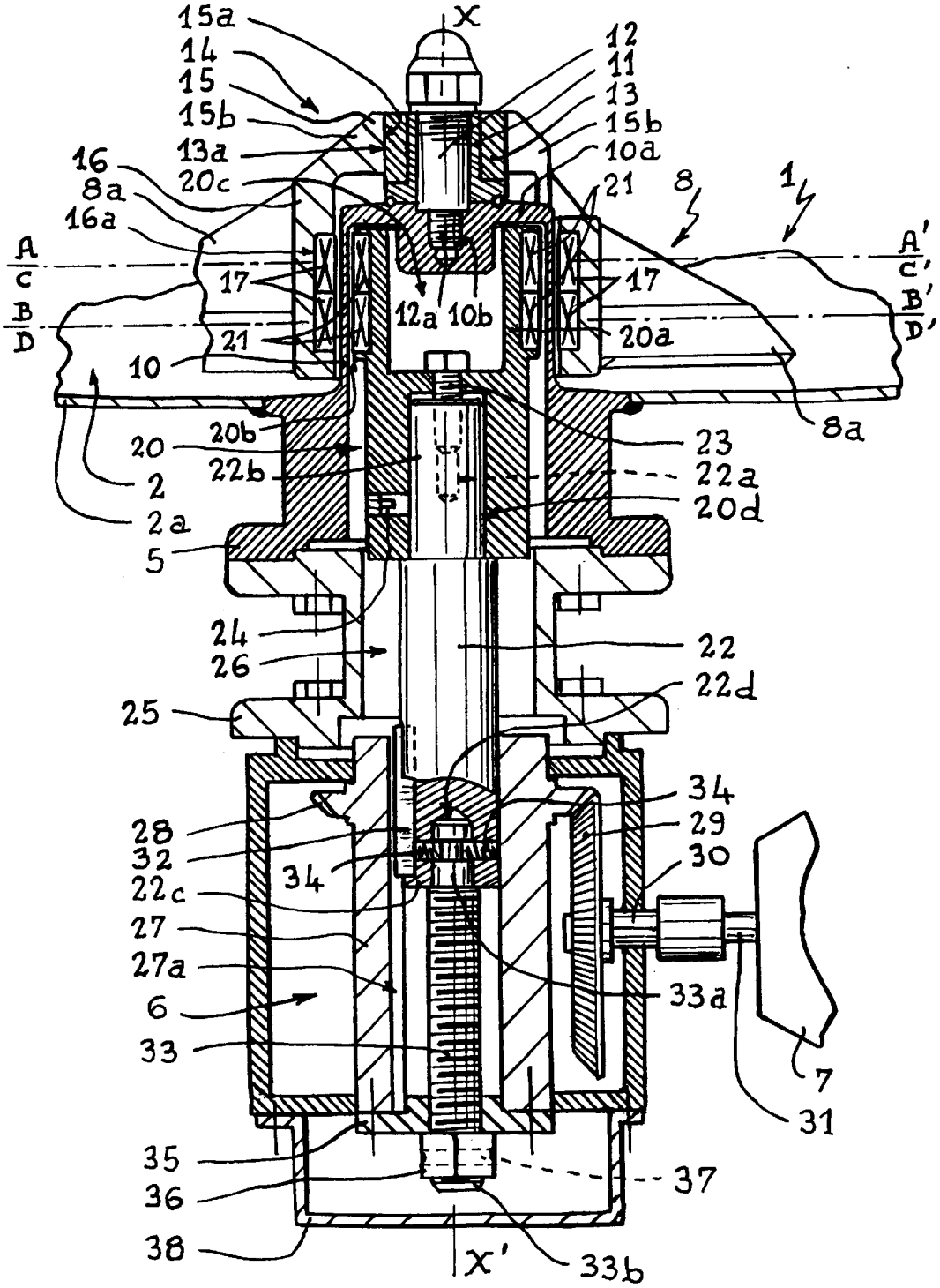
FIG. 2 is a view on a larger scale of the detail II of FIG. 1, the agitator being shown in section, in a first position.

A rotor 20 is disposed inside the sleeve 10 and comprises a first bush-shaped part 20*a* on the outer surface 20*b* of which are mounted permanent magnets 21 aligned with the magnets 17, in the configuration of FIG. 2. In this configuration, the directions C–C' and D–D' of polarity of the magnets 21 are substantially aligned with directions A–A' and B–B'. The rotor 20 is provided to rotate about axis X–X' and, thanks to the magnetic coupling produced between the magnets 21 and 17, to drive the propelling screw 8 in rotation about this axis.

The rotor 20 is secured to with a drive shaft 22 thanks to a screw 23 disposed in the central recess 20*c* of the bush 20*a* along axis X–X' and penetrating in an end tapping 22*a* of the shaft 22. The rotor 20 is provided with an axial bore 20*d* for receiving the end 22*b* of the shaft 22 in which the tapping 22*a* is made. A screw 24 is disposed in a radial bore in that part of the rotor 20 in which the bore 20*d* is made, so as to abut against the outer radial surface of the end 22*b* of the shaft 22, so as to immobilize the elements 20 and 22 in rotation.

The flange 5 is secured to a distance piece or spacer 25 on which is mounted the reduction gear 6. The distance piece 25 defines a cylindrical housing 26 for receiving the shaft 22.

A driven shaft 27 of the reduction gear 6 is driven by pinions 28 and 29, pinion 29 being in mesh, thanks to a shaft 30, with the driven shaft 31 of the motor 7. The shaft 27 is hollow and defines an inner volume in which the shaft 22 may slide, shafts 22 and 27 being fast in rotation thanks to a key 32. In this way, the shaft 22 may slide inside the shaft 27 and be driven in rotation thereby, thanks to the key 32. Reference 27*a* designates a longitudinal groove in the shaft 27 in which the key 32 may slide.

The end 22*c* of the shaft 22 opposite the rotor 20 is secured to a threaded rod 33 of which a first end 33*a* is provided to penetrate in a housing 22*d* of the end 22*c*. Two screws 34 serve to immobilize the end 33*a* of the rod 33 axially inside the housing 22*d*.

The second end 33*b* of the rod 33 cooperates with a nut 35 fixed to the end of the shaft 27 opposite the distance piece 25. A nut 36 is immobilized on the end 32*b* of the rod 33 thanks to a pin 37. It is thus possible to drive the threaded rod 33 in rotation inside the nut 35 thanks to nut 36. A screw-nut system has thus been constituted which, due to the fixed position in translation of the nut 35 with respect to the axis X–X', makes it possible to control the displacement in translation of the rod 33, the shaft 22 and the rotor 20 between the two positions respectively shown in FIGS. 2 and 3. The nut 36 therefore constitutes a means for controlling the displacement of these elements along axis X–X'.

A cap 38 is mounted on the reduction gear 6 around the end 33*b* of the threaded rod 33 in order to protect the elements 35 to 37. The cap 38, made of metal or plastics material, may be screwed or clipped on the reduction gear 6.

Figure 3:
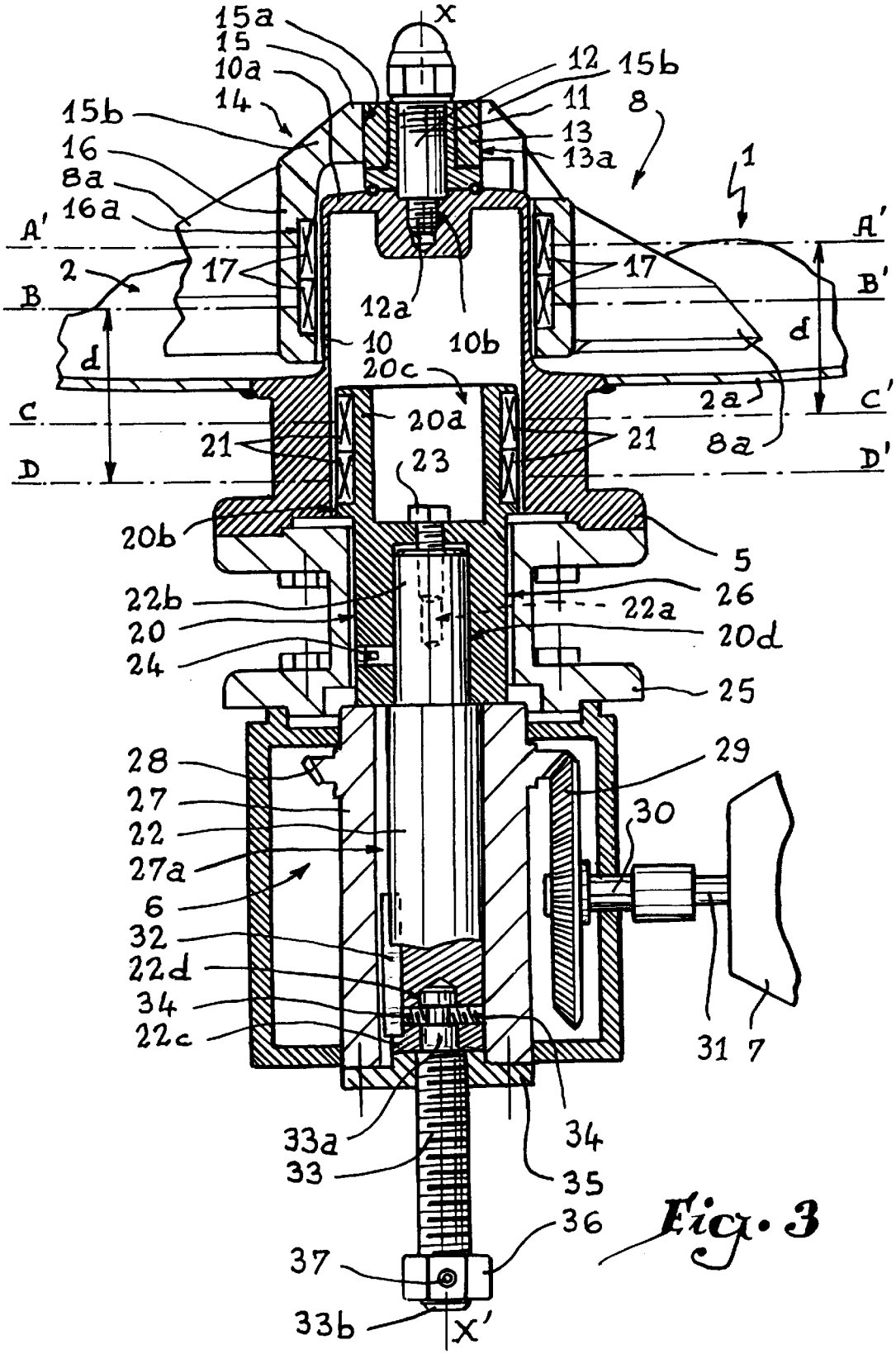
FIG. 3 is a view similar to FIG. 2, with the agitator in a second position.

Functioning is as follows:

From the position of FIG. 2, and when it is necessary to dismantle the propelling screw 8, the cap 38 is withdrawn and the nut 36 is maneuvered with a spanner in the sense of unscrewing the rod 33 with respect to the nut 35, so that this rod is progressively extracted outside the driven shaft tube 27, which consequently drives the shaft 22 in the direction of the nut 35 up to the position shown in FIG. 3. In this position, the magnets 17 and 21 are no longer opposite, since the bush 20*a* of the rotor 20 has arrived in a part of the inner volume of the sleeve 10 located outside the the tank 2. In this position, the directions of polarity C–C' and D–D' of the magnets 21 are offset with respect to the directions of polarity A–A' and B–B' of the magnets 17 by a distance d such that the force of magnetic coupling between these magnets is virtually zero. In other words, there is in that case no noteworthy magnetic interaction between the magnets 17 and 21. The propelling screw 8 may therefore be removed, without the magnetic forces exerted between the magnets 17 and 21 substantially opposing this.

At the end of the cleaning and/or maintenance operations, the propelling screw 8 may be returned in place without too great a force of attraction due to magnets 21 being exerted on magnets 17.

It is then possible to maneuver the nut 36 in the direction opposite the one mentioned above, so that the threaded rod 33 penetrates again inside the driven shaft tube 27 and the rotor 20 is pushed by the shaft 22 up to the position of FIG. 2 in which the magnets 17 and 21 are again opposite.

The displacement of the magnets 21 with respect to the magnets 17 occurs perpendicularly to the efforts of magnetic attraction which are exerted between these magnetic coupling elements, with the result that these forces do not have to be overcome while they may be particularly great if the air gap between the magnets is reduced. An effect of shear of these forces is provoked here and the movement of the rotor 20 between the positions of FIGS. 2 and 3 is relatively easy. Moreover, a considerable gear reduction may be obtained as a function of the pitch of the thread of the rod 33 and of the nut 35.

While the rotor 20 is being re-mounted inside the sleeve 10, it is possible to interrupt rotation of the threaded rod 33 in an intermediate position between those of FIGS. 2 and 3, only a fraction of the magnets 21 arriving opposite magnets 17 nearest the bottom of the tank 2. Under these conditions, the maximum couple which may be transmitted between the rotor 20 and the sheath 16 of the propelling screw 8 is less than in the position of FIG. 2, which proves useful when it is desired to limit the couple that may be transmitteed to the propelling screw 8, particularly in the case of a mixture 3 whose viscosity develops as a function of time, for example due to a chemical reaction modifying this viscosity. It is thus possible to avoid agitation of the mixture at the end of a chemical reaction, i.e. when this viscosity has attained a predetermined value. The value of the maximum couple transmissible depends on the proportion of the magnets 17 and 21 which are opposite and create a partial magnetic coupling force. It is possible to calibrate the agitator of the invention to determine the maximum couple transmissible as a function of the position of the rotor 20. After such calibration, the rod 33 may be graduated, which allows a user to move it towards the inside of the tube 27 as a function of the limiting or maximum couple desired.

A device (not shown) for detecting the effective movement of the propelling screw 8 may be associated with the agitator of the invention in order to warn the operator when the propelling screw 8 is no longer rotating whereas the motor 6 is operating, such a situation corresponding to a predetermined value of viscosity for the mixture 3. Stopping of the motor 7 may be programmed under these conditions.

When the rotor is positioned in its position of drive of the propelling screw 8, whether it be question of the position of FIG. 2 or an intermediate position, the cap 38 is re-mounted on the reduction gear 6.

Figure 4:
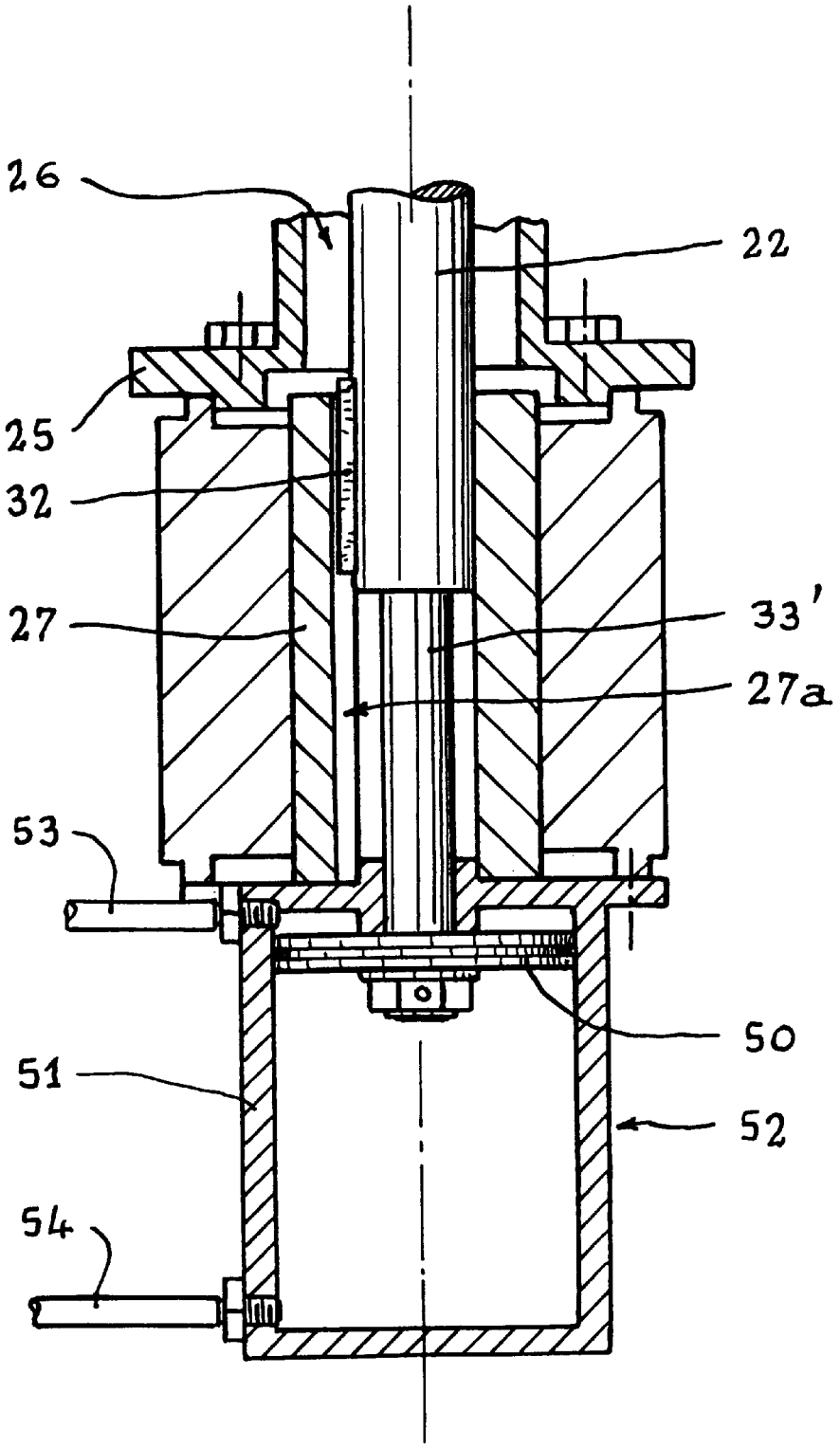
FIG. 4 is a partial view of the lower part of an agitator in accordance with a second embodiment of the invention.

In the embodiment of the invention shown in FIG. 4, elements similar to those of the embodiment of FIGS. 1 to 3 bear identical references. The agitator of this second embodiment differs from the preceding one essentially in that the end 33*b* of a rod 33', which is not threaded, is secured to a piston 50 mobile in translation along axis X–X' inside a cylinder 51. Elements 50 and 51 belonging to a pneumatic jack 52 supplied with air via two conduits 53 and 54. As a function of the pressures respectively prevailing in the chambers defined inside the cylinder 51 on either side of the piston 50, the rod 33 is displaced along axis X–X', which makes it possible to displace the magnets 21 of the rotor 20 with respect to the magnets 17 of the sheath 16, as in the first embodiment.

Jack 52 might, of course, equally well be a hydraulic jack.

The use of a jack allows a rapid movement of the rotor 20 inside the sleeve 10, which movement may be automated.

Other systems for controlling the displacement of the rotor 20 inside the sleeve 10 may be envisaged, in particular a system incorporating springs or cams.

In any case, the process described hereinbefore for adjusting the couple limiting transmission of force remains applicable.

What is claimed is:

1. Magnetically driven agitator, the agitator including a member adapted to be tightly mounted in a wall of a container and defining a hollow sleeve inside which is housed a rotor supporting a first magnetic coupling means, a propelling screw disposed around said sleeve, a second magnetic coupling means carried by said screw for driving said propelling screw about an axis of rotation by magnetic force developed between said first and second magnetic coupling means, means for rotating said rotor, and adjustment means for adjusting the position of said rotor parallel to said axis inside said sleeve between a first position where said first and second coupling means are substantially opposite one another to thereby create a maximum magnetic drive force between said first and second magnetic coupling means so that they cooperate for driving said propelling screw in rotation and selected second positions wherein said first and second magnetic coupling means are offset with respect to one another to thereby alter the magnetic drive force therebetween.

2. The agitator of claim 1, wherein said means for rotating said rotor includes a drive shaft movable in rotation about said axis and in translation parallel to said axis.

3. The agitator of claim 2, wherein said drive shaft is mounted to slide inside a hollow driven shaft of a reduction gear, and means for drivingly connecting said drive shaft and hollow shaft to rotate together.

4. The agitator of claim 3, wherein said adjustment means includes a nut mounted to said hollow shaft which is threaded on a rod secured to said drive shaft.

5. The agitator of claim 4, including means mounted to said rod for rotating said rod relative to said nut.

6. The agitator of claim 5 including a cap covering said means mounted to said rod for rotating said rod relative to said nut, and said cap being removably mounted relative to said reduction gear.

7. The agitator of claim 3 in which said means for drivingly connecting said drive shaft and said hollow shaft includes a key carried by said drive shaft which key is seated in a groove in said hollow shaft.

8. The agitator of claim 7 wherein said means for rotating said rotor further includes a drive motor, and means for drivingly connecting a driven shaft of said drive motor with said hollow shaft.

9. The agitator of claim 2, wherein said rotor is provided with a central recess for receiving one end of said drive shaft, and a screw disposed substantially along said axis for securing said drive shaft within said recess.

10. The agitator of claim 2, wherein said adjustment means includes a fluid jack operatively connected to said drive shaft.

11. The agitator of claim 1, wherein said adjustment means includes means for retaining said first and second magnetic coupling means at a selected position relative to one another intermediate said first and second positions.

12. The agitator of claim 1 in which said first and second magnetic coupling means each include a plurality of permanent magnets.

13. A mixing apparatus including a container, a magnetically driven agitator, said magnetically driven agitator including a member mounted through a wall of said container, said member including a hollow sleeve inside which is housed a rotor supporting a first magnetic coupling means, a propelling screw disposed around said sleeve, a second magnetic coupling means carried by said screw for driving said propelling screw about an axis of rotation by magnetic force developed between said first and second magnetic coupling means, means for rotating said rotor, and adjustment means for adjusting the position of said rotor parallel to said axis inside said sleeve between a first position where said first and second magnetic coupling means are substantially opposite one another to thereby create a maximum magnetic drive force therebetween so that they cooperate for rotating said propelling screw in rotation and selected second positions wherein said first and second magnetic means are offset with respect to one another to thereby alter the magnetic drive force therebetween.

14. A method for adjusting the magnetic coupling force between a magnetically driven agitator supported by a member extending through a wall of a container wherein the member includes a hollow sleeve in which is housed a rotor which supports a first magnetic coupling structure which cooperates with a second magnetic coupling structure carried by a mixing device mounted within the container so that the mixing device rotates about an axis of rotation under magnetic force developed between the first and second magnetic coupling structures, the method comprising the steps of: adjusting the position of the first magnetic coupling structure by movement along a line parallel to the axis of rotation to a first position in general alignment with respect to said second magnetic coupling structure to thereby create a maximum magnetic driving force between said first and second magnetic coupling structures; and selectively adjusting the position of the rotor to a selected one of a plurality of second positions along the line to thereby vary the magnetic driving force between said first and second magnetic coupling structures.

* * * * *

UNITED STATES PATENT AND TRADEMARK OFFICE

CERTIFICATE OF CORRECTION

PATENT NO. : 6,206,562 B1
DATED : March 27, 2001
INVENTOR(S) : Philippe Eyraud and Guy Flavien It is certified that error appears in the above-identified patent and that said Letters Patent is hereby corrected as shown below:

Title page,
Item [30], Foreign Application Priority Data, should read:
-- Jan 28, 1999 (FR) .....99 01130 --

Signed and Sealed this

Sixteenth Day of October, 2001

*Attest:*

Nicholas P. Godici

NICHOLAS P. GODICI
*Acting Director of the United States Patent and Trademark Office*

*Attesting Officer*